US006843905B2

(12) United States Patent
Stuntz et al.

(10) Patent No.: US 6,843,905 B2
(45) **Date of Patent: *Jan. 18, 2005**

(54) LOW-SULFUR FUEL

(75) Inventors: Gordon F. Stuntz, Baton Rouge, LA (US); Robert C. W. Welch, Baton Rouge, LA (US); Thomas R. Halbert, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/342,731

(22) Filed: Jan. 15, 2003

(65) Prior Publication Data

US 2003/0188994 A1 Oct. 9, 2003

Related U.S. Application Data

(62) Division of application No. 09/977,000, filed on Oct. 12, 2001, now Pat. No. 6,610,197.

(60) Provisional application No. 60/245,281, filed on Nov. 2, 2000.

(51) Int. Cl.[7] ..... C10L 1/04

(52) U.S. Cl. ..... 208/15; 208/14; 208/16

(58) Field of Search ..... 208/14, 15, 16

(56) References Cited

U.S. PATENT DOCUMENTS 6,610,197 B2 * 8/2003 Stuntz et al. ..... 208/210

* cited by examiner

*Primary Examiner*—Walter D. Griffin
*Assistant Examiner*—James Arnold, Jr.
(74) *Attorney, Agent, or Firm*—Gerard J. Hughes

(57) ABSTRACT

The invention relates to a process for forming a low-sulfur motor gasoline and the product made therefrom. In one embodiment, process involves separating a catalytically cracked naphtha into at least a light fraction boiling below about 165° F. and a heavy fraction boiling above about 165° F. The light fraction is treated to remove sulfur by a non-hydrotreating method, and the heavy fraction is hydrotreated to remove sulfur to a level of less than about 100 ppm.

3 Claims, 1 Drawing Sheet

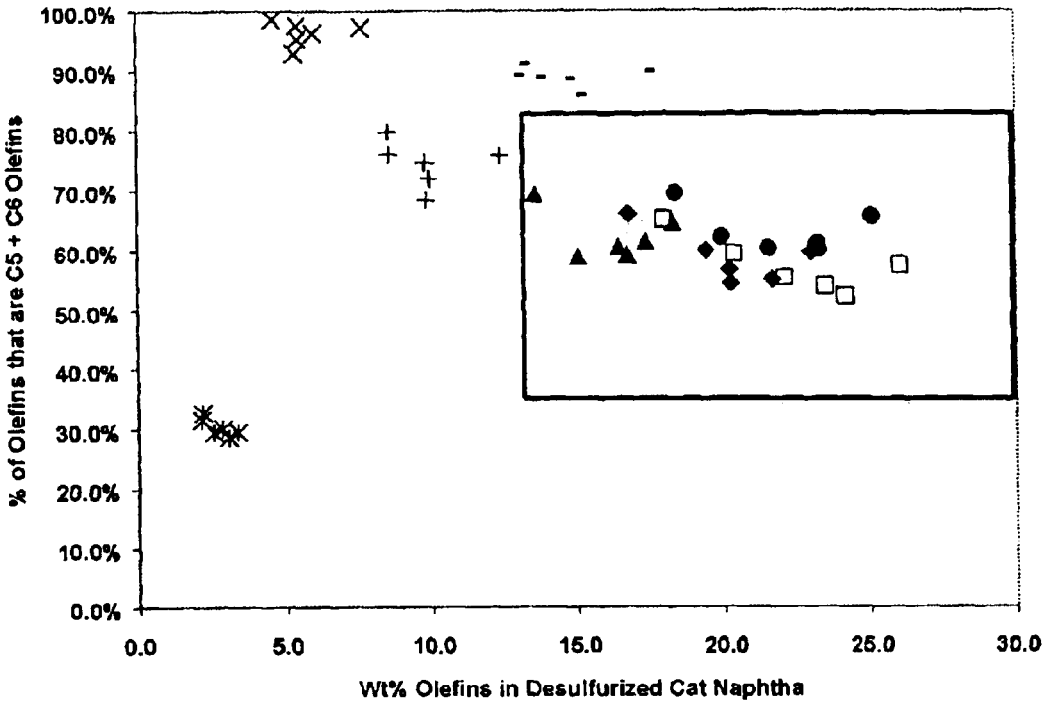
Example 2, Table 5
Example 3, Table 6
Example 4, Table 7
Example 5, Table 8
Example 6, Table 9
Example 7, Table 10
Example 8, Table 11
Example 9, Table 12

LOW-SULFUR FUEL

CROSS REFERENCE TO RELATED APPLICATIONS

This application is a divisional of U.S. application Ser. No. 09/977,000, filed Oct. 12, 2001 now U.S. Pat. No. 6,610,197, which claims priority from U.S. Provisional Application No. 60/245,281 filed Nov. 2, 2000.

FIELD OF THE INVENTION

The invention relates to a process for forming a low-sulfur motor gasoline and the product made therefrom. In one embodiment, process involves separating a catalytically cracked naphtha into at least a light fraction boiling below about 165° F. and a heavy fraction boiling above about 165° F. The light fraction is treated to remove sulfur by a non-hydrotreating method, and the heavy fraction is hydrotreated to remove sulfur to a level of less than about 100 ppm.

BACKGROUND OF THE INVENTION

Catalytically cracked naphtha ("cat naphtha") boiling in the gasoline boiling range is generally high in octane number resulting from the olefinic species contained therein. Cat naphtha may also contain sulfur impurities in sufficient quantity to warrant removal by hydroprocesssing, for example, in order to comply with product specifications and environmental regulations.

While hydroprocessing is a common method for sulfur removal, it also results in saturation of the desirable olefin species leading to a loss in cat naphtha octane number.

Some conventional processes attempt to remove the sulfur while maintaining octane number by separating the naphtha into at least a light fraction and a heavy fraction. Such processes take advantage of the observation that the olefins are concentrated in the light fraction and the sulfur in the heavy fraction. Accordingly, the light fraction is not hydroprocessed to preserve the olefin content and may be subsequently combined with the hydroprocessed heavy fraction to provide a naphtha having less sulfur without too great an octane number reduction. Unfortunately, some sulfur, such as mercaptan and thiophene sulfur, is often present in the light fraction, so further sulfur removal from the naphtha would be desirable.

At least one conventional process attempts to overcome this difficulty by treating the light fraction with a cobalt group metal chelate catalyst in an alkaline medium to oxidize the mercaptans to disulfides which are separated from the light fraction. Even so, such a treatment would not remove the thiophene from the light fraction, and further sulfur removal would therefore be desirable.

In another conventional process, reactive separation is employed to provide a relatively sulfur-free light fraction and a heavy fraction that contains monosulfides ("converted monosulfides") resulting from the reactive conversion. While the light fraction would then contain less sulfur, the hydroprocessing of the heavy fraction must be conducted at greater severity in order to remove the converted monosulfides, which leads to an undesirable loss in octane number from olefin saturation.

Yet another conventional process seeks to restore octane number in the hydroprocessed heavy fraction by subsequently cracking the hydroprocessed fraction with an acidic catalyst such as ZSM-5. While octane number may be improved, the amount of desirable olefin species in the heavy fraction will still be diminished. Moreover, in order to avoid poisoning the acidic catalyst, the hydroprocessing is generally conducted at high seventy to remove nitrogen impurities, leading to even more olefin saturation.

There is, therefore, a need for a process for forming a low-sulfur naphtha for gasoline blending from a cat naphtha without undesirable olefin saturation.

SUMMARY OF THE INVENTION

In one embodiment, the invention relates to a method for forming a low-sulfur, high-octane naphtha suitable for gasoline blending, the process comprising:

(a) separating a catalytically cracked naptha into at least a light fraction and a heavy fraction;

(b) treating the light fraction to remove sulfur at a hydrogen partial pressure of less than about 50 psig $H_2$ to form a treated light fraction having a sulfur content less than about 150 ppm; and then (c) treating the heavy fraction in the presence of a catalytically effective amount of a hydroprocessing catalyst under catalytic conversion condition in order to form a treated heavy fraction having a sulfur content less than about 150 ppm, based on the weight of the heavy fraction, and wherein the treated heavy fraction has at least 10% of the $C_6$+ olefin in the heavy fraction.

In another embodiment, the invention relates to a product formed in accordance with such a process.

In another embodiment, the invention relates to a naphtha-boiling-range hydrocarbon suitable for gasoline blending, the hydrocarbon comprising olefins having at least 5 carbon atoms wherein (i) the hydrocarbon contains no more than about 13 wt. % olefins, based on the weight of the hydrocarbon;

(ii) the percentage of olefins having at least 5 carbon atoms that are $C_5$ and $C_6$ olefins ranges from about 45% to about 65%; and (iii) the hydrocarbon contains less than about 60 ppm sulfur, based on the weight of the hydrocarbon.

In one embodiment, the olefins having a carbon number of at least $C_5$ are present in an amount ranging from about 13 wt. % to about 30 wt. %, based on the weight of the hydrocarbon, and about 25% to about 45% of the olefins having a carbon number of at least $C_5$ are $C_5$ olefins.

BRIEF DESCRIPTION OF THE FIGURE

The FIGURE illustrates the olefin content and distribution for representative naphthas produced in accordance with one embodiment of the process of the invention and in accordance with conventional processes. The abscissa is the wt. % of total olefins present in the desulfurized cat naphtha, based on the total weight of the desulfurized cat naphtha. The ordinate is the fraction (represented as a percent) of the total olefins having a carbon number of at least 5 that are $C_5$ and $C_6$ olefins.

DETAILED DESCRIPTION OF THE INVENTION

The invention is based in part on the discovery that a low-sulfur, high-octane cat naphtha may be provided by regulating the cut point in a cat naphtha separation to provide a light fraction containing mercaptan sulfur and a heavy fraction containing thiophene sulfur. The light fraction is then processed using no more than a 50 psig hydrogen partial pressure to remove the mercaptan and other sulfur to a level of less than about 150 ppm. The heavy fraction is hydroprocessed to remove thiophene and other sulfur to a level of less than about 150 ppm, but the hydroprocessing is regulated to provide for retention of a substantial amount of $C_5$, $C_6$, and higher molecular weight olefins in order to ameliorate octane number loss. The desulfurized light and heavy fractions may be used alone and in combination as blendstock for low-sulfur, high-octane gasoline.

In one embodiment, cat naphtha feeds are employed that have a boiling range from about 65° F. to about 430° F. The naphtha can be any stream predominantly boiling in the naphtha boiling range and containing olefins, for example, a thermally cracked or a catalytically cracked naphtha. Such streams can be derived from any appropriate source, for example, they can be derived, for example, from the fluid catalytic cracking ("FCC") of gas oils and resids from delayed or fluid coking of resids, and from steam cracking and related processes. The naphtha streams used may be derived from the fluid catalytic cracking of gas oils and resids. Such naphtha typically contains hydrocarbon species such as paraffins, olefins, naphthenes, and aromatics. Such naphtha may also and generally does contain heteroatom, e.g., sulfur and nitrogen, species. Heteroatom species include, for example, mercaptans and thiophenes. Undesirably, significant amounts of such heteroatom species may be present. FCC cat naphtha typically contains 20 to 40 wt. % olefins, based on the weight of the cat naphtha. Of these olefins, $C_5$ olefins are typically present as 20% to about 30% of the total amount of olefins, and combined $C_5$ and $C_6$ olefin content is typically about 45% to about 65% of the total $C_5$+ olefins present.

The cat naphtha feed may be separated by methods such as splitting and fractionation in order to provide at least a light cat naphtha fraction and a heavy cat naphtha fraction. In one embodiment, the separation cut point between the light and heavy fraction is regulated so that a substantial amount of the mercaptan and olefins having fewer than six carbons ("$C_6^{-=}$") are present in the light fraction and a substantial amount of the thiophene and the olefins having 6 or more carbons ("$C_6^{+=}$") are present in the heavy fraction. Accordingly, the cut point is regulated so that light fraction boils in the range of about 65° F. to about 165° F., preferably from about 65° F. to about 150° F., and more preferably in the range of about 65° F. to about 115° F. Thus the heavy fraction may have a boiling point in the range of about 165° F. to about 430° F., preferably 150° F. to about 430° F., and more preferably from about 115° F. to about 430° F. Those skilled in the art are aware that hydrocarbon separations are imperfect and, consequently, some overlap in the boiling points of the light and heavy fractions may occur near the cut point. Even so, the light fraction will typically contain more than 50% of the $C_5$ olefins contained in the cat naphtha feed. The heavy fraction will typically contain more than 50% of the $C_6$ olefin contained in the cat naphtha feed. For an FCC cat naphtha, about 10 wt. % to about 40 wt. % of the total weight of the cat naphtha is in the light fraction and about 90% to about 60 wt. % of the total weight of the cat naphtha is in the heavy fraction.

In one embodiment, the light fraction is processed to remove sulfur while preserving the olefin content to maintain octane number. Accordingly, the light fraction is desulfurized via a non-hydrotreating process (i.e., a process employing no more than 50 psig hydrogen partial pressure) to remove sulfur species such as mercaptan. Preferably, the desulfurized light fraction has a sulfur content of less than about 100 ppm, more preferably less than 75 ppm, and still more preferably less than about 50 ppm, based on the weight of the light fraction. A substantial portion of the olefins in the light fraction (mostly $C_5$ olefins but generally also some $C_6$ olefins) can be preserved during sulfur removal. In an embodiment, more than 75% of the $C_5$ olefins are retained following sulfur removal, preferably more than 90%, based on the total weight of $C_5$ olefins in the light fraction. MEROX™ and EXTRACTIVE MEROX™, Universal Oil Products, Des Plaines, Ill., are suitable processes for removing sulfur while preserving olefin content, as are sulfur absorption processes set forth, for example, in U.S. Pat. No. 5,843,300. It should be noted that such processes are representative, and that any non-hydrotreating process capable of removing sulfur to a level lower than 150 ppm can be employed.

In one embodiment, the heavy fraction is hydrodesulfurized, for example via catalytic hydroprocessing, with a hydrogen partial pressure greater than 50 psig in order to remove sulfur-containing species such as thiophene. The desulfurized heavy fraction typically has a sulfur content of less than about 100 ppm, more preferably less than about 75 ppm, and still more preferably less than about 50 ppm. In one embodiment, the hydroprocessing is conducted under selective hydroprocessing conditions in order to remove sulfur-containing species while minimizing olefin saturation. In regulatory environments where motor gasoline olefin content is limited, there is an incentive to preserve the amount of those olefins making the greatest contribution to octane number. Accordingly, for highest MON and RON values, the amount of $C_5$ and $C_6$ olefin should be preserved in the heavy fraction during hydroprocessing by, for example, selective hydroprocessing.

The term "hydroprocessing" is used broadly herein and includes processes such as hydrofining, hydrotreating, and hydrocracking. As is known by those of skill in the art, the degree of hydroprocessing can be controlled through proper selection of catalyst as well as by optimizing operating conditions. Hydroprocessing may be conducted under conditions, set forth in detail below, that do not result in converting a substantial portion of olefins into paraffins, but that do result in the removal of objectionable species including non-hydrocarbyl species that may contain sulfur, nitrogen, oxygen, halides, and certain metals. Such conditions are referred to herein as "selective hydroprocessing" conditions.

Accordingly, the selective hydroprocessing reaction can be conducted in one or more stages at a temperature ranging from about 200° C. to about 400° C., more preferably from about 250° C. to about 375° C. The reaction pressure preferably ranges from about 50 to about 1000 psig, more preferably from about 50 to about 300 psig. The hourly space velocity preferably ranges from about 0.1 to about 10 V/V/Hr, more preferably from about 2 to about 7 V/V/Hr, where V/V/Hr is defined as the volume of oil per hour per volume of catalyst. The hydrogen containing gas can be added to establish a hydrogen charge rate ranging from about 500 to about 5000 standard cubic feet per barrel (SCF/B), more preferably from about 1000 to about 3000 SCF/B. When more than one stage is used, sulfur, typically in the form of $H_2S$, may be removed from the process between successive stages. Successive stages may be operated under similar hydroprocessing conditions. Lower sulfur concentration in downstream stages is believed to result in diminished mercaptan reversion in the presence of olefins that were selectively retained in the upstream selective hydroprocessing stages.

Selective hydroprocessing conditions can be maintained by use of any of several types of hydroprocessing reactors. Trickle bed reactors are most commonly employed in petroleum refining applications with co-current downflow of liquid and gas phases over a fixed bed of catalyst particles. It can be advantageous to utilize alternative reactor technologies. Countercurrent-flow reactors, in which the liquid phase passes down through a fixed bed of catalyst against upward-moving treat gas, can be employed to obtain higher reaction rates and to alleviate aromatics hydrogenation equilibrium limitations inherent in co-current flow trickle bed reactors. Moving bed reactors can be employed to increase tolerance for metals and particulates in the hydroprocessor feed stream. Moving bed reactor types generally include reactors wherein a captive bed of catalyst particles is contacted by upward-flowing liquid and treat gas. The catalyst bed can be slightly expanded by the upward flow or substantially expanded or fluidized by increasing flow rate, for example, via liquid recirculation (expanded bed or ebullating bed), use of smaller size catalyst particles which are more easily fluidized (slurry bed), or both. In any case, catalyst can be removed from a moving bed reactor during onstream operation, enabling economic application when high levels of metals in feed would otherwise lead to short run lengths in the alternative fixed bed designs. Furthermore, expanded or slurry bed reactors with upward-flowing liquid and gas phases would enable economic operation with feedstocks containing significant levels of particulate solids, by permitting long run lengths without risk of shutdown due to fouling. Moving bed reactors utilizing downward-flowing liquid and gas can also be applied, as they would enable onstream catalyst replacement.

In one embodiment, the hydroprocessing catalyst contains at least one Group VIII metal and a Group VI metal on an inorganic refractory support, which is preferably alumina or alumina-silica. The Group VIII and Group VI compounds are well known to those of ordinary skill in the art and are well defined in the Periodic Table of the Elements. For example, these compounds are listed in the Periodic Table found at the last page of Advanced Inorganic Chemistry, 2nd Edition 1966, Interscience Publishers, by Cotton and Wilkinson. The Group VIII metal is preferably present in an amount ranging from 0.5 to 20 wt. %, preferably 1 to 12 wt. %. Preferred Group VIII metals include Co, Ni, and Fe, with Co and Ni being most preferred. The preferred Group VI metal is Mo which is present in an amount ranging from 1 to 50 wt. %, preferably 1.5 to 40 wt. %, and more preferably from 2 to 30 wt. %.

Where selective hydroprocessing is employed, and especially where selective hydrodesulfurization ("selective HDS") is employed, a representative hydroprocessing catalyst can contain 1 to 10 wt. % $MoO_3$ and 0.1 to 5 wt. % CoO supported on alumina, silica-alumina, or other conventional support materials. Generally, the support surface area may range from about 100 to about 400 $m^2/g$. The catalyst may contain small amounts of iron and $SO_4$. The total surface area of the catalyst may range from about 150 to about 350 $m^2/g$, while the pore volume may range from about 0.5 to about 1.0 $cm^3/g$, as measured by mercury intrusion. When metals are impregnated into or on to the support, the impregnation should be conducted to provide a final catalyst composition having oxygen chemisorption values set forth in the range of Table 1. The catalyst may also contain about 0 to about 10 wt. % phosphorus which may be added at any time during catalyst preparation.

In the selective hydrotreating process, the catalyst may be loaded into the hydrotreating reactor in the oxidized form and sulfided by conventional methods prior to treating the cracked naphtha.

TABLE 1

Metals Dispersion by the Oxygen Chemisorption Test *

| | μmol oxygen/gram $MoO_3$ | |
|---|---|---|
| | Minimum | Maximum |
| Broad Range | 800 | 2800 |
| Preferred | 1000 | 2200 |
| Most Preferred | 1200 | 2000 |

* Oxygen chemisorption measured on sulfided catalysts

In an embodiment, the selective hydroprocessing catalyst may contain about 0 to about 5 wt. % Group IA elements, especially potassium, for activity, selectivity, or a combination of activity and selectivity enhancements. The elements may be added at any time during the preparation of the catalyst.

The selective hydroprocessing catalyst when used in accordance with the selective hydroprocessing conditions set forth herein provides both high activity and selectivity for selective naphtha hydroprocessing. The high selectivity of the catalyst provides abated olefin hydrogenation at a given sulfur removal level as compared to conventional hydroprocessing catalysts. The olefin hydrogenation abatement leads to reduced hydrogen consumption and substantially diminishes octane losses in the hydrotreated heavy fraction.

All metals and metal oxide weight percents given are on support. The term "on support" means that the percents are based on the weight of the support. For example, if a support weighs 100 g, then 20 wt. % Group VIII metal means that 20 g of the Group VIII metal is on the support.

Any suitable inorganic oxide support materials may be used for the hydroprocessing catalyst of the present invention, including the selective hydroprocessing catalyst. Alumina and silica-alumina, including crystalline aluminosilicate such as zeolite are representative supports. Alumina is employed in one embodiment. The silica content of the silica-alumina support can be from about 2 to about 30 wt. %, preferably about 3 to about 20 wt. %, and more preferably about 5 to about 19 wt. %. Other refractory inorganic compounds may also be used, non-limiting examples of which include zirconia, titania, magnesia, and the like. The alumina can be any of the aluminas conventionally used for hydroprocessing catalysts. Such aluminas are generally porous amorphous alumina having an average pore size from about 50 to about 200 Å, preferably about 70 to about 150 Å, and a surface area from about 50 to about 450 $m^2/g$.

In one embodiment, the hydroprocessed heavy fraction has a boiling point in the range of about 115° F. to about 430° F. and retains at least about 45%, and more preferably at least about 75% of the olefins present in the heavy fraction before hydroprocessing. Still more preferably, at least about 50% to about 90% of the olefins present in the heavy fraction are preserved during hydroprocessing and are present in the hydroprocessed heavy fraction.

It is within the scope of the invention to further process the hydroprocessed heavy fraction by, for example, sulfur absorption and catalytic reforming.

In one embodiment, the heavy fraction comprises an intermediate cat naphtha portion ("ICN") and a heavy cat naphtha portion ("HCN"). The initial boiling point for the HCN portion ranges from about 115° F. to about 165° F. (preferably about 115° F.), and is in the range of about 350° F. to about 380° F. (preferably about 365° F.) for the HCN.

The final boiling point ranges from about 350° F. to about 380° F. (preferably about 365° F.) for the ICN and from about 410° F. to about 480° F. for the HCN (preferably about 430° F.). The ICN and HCN can be processed independently to remove sulfur. Accordingly, in one embodiment, the ICN portion is selectively hydroprocessed and the HCN is non-selectively hydroprocessed. All or a portion of the hydroprocessed ICN and HCN can be combined to form the desulfurized heavy fraction.

In one embodiment, all or a portion of desulfurized light and heavy fractions may be combined or, alternatively, independently selected for blending to form a motor gasoline. In an embodiment where the process' light and heavy fractions are combined to form a product, preferably no more than about 20% of the total olefins in that product would be heavier than $C_5$ and $C_6$ olefins, based on the total amount of olefins in that product. Preferably, at least about 10% of the hydroprocessed heavy fraction's $C_5$+ olefins are $C_5$ and $C_6$ olefins, and still more preferably about 40% to about 70% of the hydroprocessed heavy fraction's $C_5$+ olefins are $C_5$ and $C_6$ olefins. Motor gasoline blending is known to those skilled in the art. Representative hydrocarbons that may be blended with the desulfurized light fraction, desulfurized heavy fraction, or some combination thereof include alkylate, butanes, reformate, light virgin naphtha, and isomerate.

One product that may be formed from the process of the invention comprises at least a portion of the desulfurized light fraction and at least a portion of the desulfurized heavy fraction.

Another product that may be formed in the process of the invention is a naphtha that may be used for motor gasoline blending comprising about 30 wt. % to about 50 wt. % of a combination of the desulfurized light fraction and desulfurized heavy fractions, based on the weight of the naphtha. Preferably, the desulfurized light fraction is present in an amount ranging from about 5 wt. % to about 30 wt. %, based on the weight of the combined fractions, the balance of the combined light and heavy product being the desulfurized heavy fraction. Preferably, for this naphtha, the percentage of $C_5$ and $C_6$ olefins in the combined fractions ranges from about 5 wt. % to about 8 wt. % and from about 3 wt. % to about 9 wt. % respectively, based on the weight of the combined fractions. The balance of the naphtha may contain about 50 wt. % to about 70 wt. % of other motor gasoline blendstocks (including conventional blendstocks such as light virgin naphtha, reformate, isomerate, alkylate, and butanes) which together would generally contain no more than about 50 ppm sulfur and about 5 wt. % olefins, based on the weight of the naphtha. The resulting naphtha product would, therefore, comprise about 5 to about 15 wt. % total olefins where greater than 25%, preferably greater than 35%, and more preferably greater than 40% of the total weight of olefins in the naphtha are $C_5$ olefins and where greater than 50%, preferably greater than 60%, and more preferably greater than 70% of the total weight of olefins in the naphtha are $C_5$ plus $C_6$ olefins.

The naphtha's sulfur content is preferably less than 50 ppm and more preferably less than 30 ppm, based on the weight of the naphtha.

EXAMPLES

Example 1

Six FCC naphtha samples (Examples 1–6) having nominal boiling ranges of 65–430° F. were obtained from conventional catalytic cracking units. The olefin content, sulfur content and amount of olefins having five ($C_5$ olefins) and six ($C_6$ olefins) carbon atoms were measured and are provided in the table below. The percentage of total olefins that are $C_5$ olefins and the percentage that are $C_5$ plus $C_6$ olefins are also provided.

TABLE 2

| | Sample Number | | | | | |
|---|---|---|---|---|---|---|
| 65–430° F. | A | B | C | D | E | F |
| Percentage of full cat naphtha | 100% | 100% | 100% | 100% | 100% | 100% |
| Wt. % Total Olefins | 28.5 | 25.4 | 33.6 | 30.5 | 21.5 | 21.9 |
| Wt. % C5 Olefins | 6.3 | 6.2 | 8.4 | 6.2 | 5.9 | 6.4 |
| Wt. % C6 Olefins | 8.6 | 7.5 | 9.9 | 8.8 | 6.8 | 7.2 |
| % of Olefins that are C5 Olefins | 22.2% | 24.3% | 24.9% | 20.1% | 27.5% | 29.4% |
| % of Olefins that are C5 + C6 Olefins | 52.4% | 53.8% | 54.5% | 48.8% | 59.1% | 62.3% |
| Sulfur, ppm | 860 | 540 | 1070 | 1300 | 220 | 1180 |

Samples A–F were each separated by distillation into three fractions having nominal boiling ranges of 65–115° F., 115–365° F., and 365–430° F. These fractions were analyzed in the same manner as above. The results are provided in Table 3 below.

TABLE 3

| | Sample Number | | | | | |
|---|---|---|---|---|---|---|
| 65–115° F. | G | H | I | J | K | L |
| Percentage of full cat naphtha | 8.8 | 11.4 | 11.6 | 6.9 | 12.9 | 9.4 |
| Wt. % Total Olefins | 61.9 | 52.7 | 65.8 | 67.2 | 41.3 | 58.5 |

TABLE 3-continued

| | | | | | | |
|---|---|---|---|---|---|---|
| Wt. % C5 Olefins | 58.9 | 49.8 | 61.1 | 62.8 | 37.7 | 54.7 |
| Wt. % C6 Olefins | 1.4 | 0.9 | 2.9 | 3.4 | 0.6 | 1.1 |
| % of Olefins that are C5 Olefins | 95.2% | 94.6% | 92.9% | 93.5% | 91.3% | 93.5% |
| % of Olefins that are C5 + C6 Olefins | 97.5% | 96.3% | 97.2% | 98.6% | 92.9% | 95.4% |
| Sulfur, ppm | 30 | 70 | 70 | 40 | 50 | 110 |

| | Sample Number | | | | | |
|---|---|---|---|---|---|---|
| ICN 115–365° F. | M | N | O | P | Q | R |
| Percentage of full cat naphtha | 74.3 | 74.0 | 72.0 | 75.7 | 71.9 | 72.1 |
| Wt. % Total Olefins | 30.3 | 25.6 | 32.8 | 34.4 | 22.2 | 21.1 |
| Wt. % C5 Olefins | 1.4 | 0.7 | 0.7 | 2.7 | 1.4 | 1.3 |
| Wt. % C6 Olefins | 11.0 | 9.5 | 12.7 | 11.5 | 9.2 | 9.6 |
| % of Olefins that are C5 Olefins | 4.6% | 2.7% | 2.2% | 7.9% | 6.2% | 6.3% |
| % of Olefins that are C5 + C6 Olefins | 40.8% | 40.0% | 41.0% | 41.4% | 47.5% | 51.7% |
| Sulfur, ppm | 536 | 406 | 790 | 958 | 91 | 450 |

| | Sample Number | | | | | |
|---|---|---|---|---|---|---|
| HCN 365–430° F. | S | T | U | V | W | X |
| Percentage of full cat naphtha | 16.9 | 14.6 | 16.4 | 17.4 | 15.2 | 18.5 |
| Wt. % Total Olefins | 1.5 | 1.3 | 1.2 | 2.0 | 0.4 | 0.6 |
| Wt. % C5 Olefins | 0.0 | 0.0 | 0.0 | 0.0 | 0.0 | 0.0 |
| Wt. % C6 Olefins | 0.0 | 0.0 | 0.0 | 0.0 | 0.0 | 0.0 |
| % of Olefins that are C5 Olefins | 0.0% | 1.3% | 0.0% | 0.0% | 0.0% | 0.0% |
| % of Olefins that are C5 + C6 Olefins | 0.5% | 1.9% | 0.6% | 0.7% | 0.0% | 0.0% |
| Sulfur, ppm | 2277 | 1404 | 2555 | 2684 | 921 | 4202 |

Samples A–F were also each separated by distillation into fractions having nominal boiling ranges of 65–165° F. and 165–365° F. These fractions were analyzed in the same manner as above. It should be noted that the ICN/HCN cut-point is the same here as in Table 3. For brevity, the HCN data is not repeated. The results are provided in Table 4 below.

TABLE 4

| | Sample Number | | | | | |
|---|---|---|---|---|---|---|
| 65–165° F. | Y | Z | AA | AB | AC | AD |
| Percentage of full cat naphtha | 23.8 | 26.1 | 25.7 | 21.0 | 30.9 | 23.3 |
| Wt. % Total Olefins | 55.5 | 47.7 | 61.8 | 63.6 | 38.9 | 52.6 |
| Wt. % C5 Olefins | 26.0 | 23.7 | 29.6 | 30.0 | 19.0 | 26.0 |
| Wt. % C6 Olefins | 27.8 | 22.4 | 30.6 | 30.3 | 18.0 | 24.6 |
| % of Olefins that are C5 Olefins | 46.9% | 49.8% | 47.9% | 47.3% | 48.8% | 49.5% |
| % of Olefins that are C5 + C6 Olefins | 97.1% | 96.7% | 97.5% | 95.0% | 95.1% | 96.2% |
| Sulfur, ppm | 106 | 104 | 147 | 175 | 44 | 170 |

| | Sample Number | | | | | |
|---|---|---|---|---|---|---|
| ICN 165–365° F. | AE | AF | AG | AH | AI | AJ |
| Percentage of full cat naphtha | 59.3 | 59.4 | 57.9 | 61.6 | 54.0 | 58.2 |
| Wt. % Total Olefins | 24.9 | 21.1 | 26.5 | 28.1 | 17.2 | 14.5 |
| Wt. % C5 Olefins | 0.0 | 0.0 | 0.0 | 0.1 | 0.0 | 0.0 |
| Wt. % C6 Olefins | 2.8 | 2.3 | 2.8 | 4.2 | 2.1 | 2.2 |
| % of Olefins that are C5 Olefins | 0.0% | 0.0% | 0.0% | 0.3% | 0.0% | 0.0% |
| % of Olefins that are C5 + C6 Olefins | 11.3% | 10.7% | 10.6% | 15.4% | 12.2% | 15.3% |
| Sulfur, ppm | 633 | 474 | 931 | 1122 | 108 | 508 |

Comparative Example 2

Conventional naphtha hydrodesulfurization technology typically results in high levels of olefin saturation. To illustrate this, it was assumed (based on a process model) that 90% olefin saturation would occur at the high HDS levels required to reduce the sulfur content of the 65–430° F. naphthas A–F to 30 ppm S. The total olefin content and the percentage of total olefins that are $C_5$ olefins and the percentage that are $C_5$ plus $C_6$ olefins following this HDS step are provided in Table 5 below as samples 2-A through 2-F. It should be noted that in accordance with the process model, olefin saturation is independent of olefin molecular weight. As used herein, the percentage of olefins of a particular molecular weight (e.g., percent of $C_5$ olefin) is calculated by dividing the weight percent of that molecular weight olefin by the total weight percent of olefins.

TABLE 5

| 65–430° F. treated by conventional hydrotreating | 2-A | 2-B | 2-C | 2-D | 2-E | 2F |
|---|---|---|---|---|---|---|
| Percentage of full cat naphtha | 100.0 | 100.0 | 100.0 | 100.0 | 100.0 | 100.0 |
| Sulfur, ppm | 30 | 30 | 30 | 30 | 30 | 30 |
| % HDS | 96.5% | 94.4% | 97.2% | 97.7% | 86.4% | 97.5% |
| % Olefin Saturation | 90.0% | 90.0% | 90.0% | 90.0% | 90.0% | 90.0% |
| Wt. % Total Olefins | 2.8 | 2.5 | 3.4 | 3.1 | 2.1 | 2.2 |
| Wt. % C5 Olefins | 0.6 | 0.6 | 0.8 | 0.6 | 0.6 | 0.6 |
| Wt. % C6 Olefins | 0.9 | 0.8 | 1.0 | 0.9 | 0.7 | 0.7 |
| % of Olefins that are C5 Olefins | 22.2% | 24.3% | 24.9% | 20.1% | 27.5% | 29.4% |
| % of Olefins that are C5 + C6 Olefins | 30.1% | 29.5% | 29.6% | 28.7% | 31.6% | 32.8% |

Comparative Example 3

Another FCC naphtha desulfurization process treats the light cat naphtha stream using commercially available caustic extraction technology and hydrotreats the intermediate and heavy FCC naphtha streams. Caustic extraction removes about 90% of the sulfur and preserves 100% of the olefins present. In a simulation illustrating such a process, 90% of the sulfur was removed while retaining 100% of the olefins in the 65–115° F. streams of Example 1 (G–L). In the simulation, the ICN and HCN streams of Example 1 (M–R and S–X, respectively) underwent severe hydrotreating to reduce the sulfur content to 30 and 10 ppm S, respectively, with complete saturation of the olefins to paraffins. A simulated blending of these streams provided samples 3-A to 3-F in Table 6 below.

TABLE 6

| 65–115° F. treated by caustic extraction | | | | | | |
|---|---|---|---|---|---|---|
| Percentage of full cat naphtha | 8.8 | 11.4 | 11.6 | 6.9 | 12.9 | 9.4 |
| Wt. % Total Olefins | 61.9 | 52.7 | 65.8 | 67.2 | 41.3 | 58.5 |
| Wt. % C5 Olefins | 58.9 | 49.8 | 61.1 | 62.8 | 37.7 | 54.7 |
| Wt. % C6 Olefins | 1.4 | 0.9 | 2.9 | 3.4 | 0.6 | 1.1 |
| Sulfur, ppm | 3 | 7 | 7 | 4 | 5 | 11 |
| ICN 115–365° F. treated by hydrotreating | | | | | | |
| Percentage of full cat naphtha | 74.3 | 74.0 | 72.0 | 75.7 | 71.9 | 72.1 |
| Sulfur, ppm | 30 | 30 | 30 | 30 | 30 | 30 |
| % HDS | 94.4% | 92.6% | 96.2% | 96.9% | 67.0% | 93.3% |
| % Olefin Saturation | 100.0% | 100.0% | 100.0% | 100.0% | 100.0% | 100.0% |
| Wt. % Total Olefins | 0.0 | 0.0 | 0.0 | 0.0 | 0.0 | 0.0 |
| Wt. % C5 Olefins | 0.0 | 0.0 | 0.0 | 0.0 | 0.0 | 0.0 |
| Wt. % C6 Olefins | 0.0 | 0.0 | 0.0 | 0.0 | 0.0 | 0.0 |
| HCN 365–430° F. treated by hydrotreating | | | | | | |
| Percentage of full cat naphtha | 16.9 | 14.6 | 16.4 | 17.4 | 15.2 | 18.5 |
| Wt. % Total Olefins | 0.0 | 0.0 | 0.0 | 0.0 | 0.0 | 0.0 |
| Wt. % C5 Olefins | 0.0 | 0.0 | 0.0 | 0.0 | 0.0 | 0.0 |
| Wt. % C6 Olefins | 0.0 | 0.0 | 0.0 | 0.0 | 0.0 | 0.0 |
| Sulfur, ppm | 10 | 10 | 10 | 10 | 10 | 10 |
| Blended Cat Naphtha Products | 3-A | 3-B | 3-C | 3-D | 3-E | 3-F |
| Wt. % Total Olefins | 5.4 | 6.0 | 7.6 | 4.6 | 5.3 | 5.5 |
| Wt. % C5 Olefins | 5.2 | 5.7 | 7.1 | 4.3 | 4.9 | 5.1 |
| Wt. % C6 Olefins | 0.1 | 0.1 | 0.3 | 0.2 | 0.1 | 0.1 |
| Sulfur, ppm | 24.3 | 24.5 | 24.1 | 24.7 | 23.7 | 24.5 |
| % of Olefins that are C5 Olefins | 95.2% | 94.6% | 92.9% | 93.5% | 91.3% | 93.5% |
| % of Olefins that are C5 + C6 Olefins | 97.5% | 96.3% | 97.2% | 98.6% | 92.9% | 95.4% |

Comparative Example 4

Yet another FCC naphtha desulfurization process treats the light cat naphtha stream using commercially available caustic extraction technology, hydrotreats the ICN at mild conditions with a conventional catalyst, and hydrotreats the HCN at relatively severe conditions, i.e., conditions that result in desulfurization, but also significant olefin saturation. In a simulation illustrating such a process, 90% of the sulfur was removed while retaining 100% of the olefins in the 65–115° F. streams of Example 1 (G–L). In the simulation, the ICN streams of Example 1 (M–R) underwent mild hydrotreating with a conventional catalyst to reduce the sulfur content to 30 ppm S with 80% olefin saturation and the HCN streams of Example 1 (S–X) were severely hydrotreated to 10 ppm S with 100% saturation of the olefins. A simulated blending of the streams provided samples 4-A to 4-F Table 7 below.

TABLE 7

| 65–115° F. treated by caustic extraction | | | | | | |
|---|---|---|---|---|---|---|
| Percentage of full cat naphtha | 8.8 | 11.4 | 11.6 | 6.9 | 12.9 | 9.4 |
| Wt. % Total Olefins | 61.9 | 52.7 | 65.8 | 67.2 | 41.3 | 58.5 |
| Wt. % C5 Olefins | 58.9 | 49.8 | 61.1 | 62.8 | 37.7 | 54.7 |
| Wt. % C6 Olefins | 1.4 | 0.9 | 2.9 | 3.4 | 0.6 | 1.1 |
| Sulfur, ppm | 3 | 7 | 7 | 4 | 5 | 11 |
| ICN 115–365° F. treated by mild hydrotreating | | | | | | |
| Percentage of full cat naphtha | 74.3 | 74.0 | 72.0 | 75.7 | 71.9 | 72.1 |
| Sulfur, ppm | 30 | 30 | 30 | 30 | 30 | 30 |
| % HDS | 94.4% | 92.6% | 96.2% | 96.9% | 67.0% | 93.3% |
| % Olefin Saturation | 80.0% | 80.0% | 80.0% | 80.0% | 80.0% | 80.0% |
| Wt. % Total Olefins | 6.1 | 5.1 | 6.6 | 6.9 | 4.4 | 4.2 |
| Wt. % C5 Olefins | 0.3 | 0.1 | 0.1 | 0.5 | 0.3 | 0.3 |
| Wt. % C6 Olefins | 2.2 | 1.9 | 2.5 | 2.3 | 1.8 | 1.9 |
| HCN 365–430° F. treated by severe hydrotreating | | | | | | |
| Percentage of full cat naphtha | 16.9 | 14.6 | 16.4 | 17.4 | 15.2 | 18.5 |
| Wt. % Total Olefins | 0.0 | 0.0 | 0.0 | 0.0 | 0.0 | 0.0 |
| Wt. % C5 Olefins | 0.0 | 0.0 | 0.0 | 0.0 | 0.0 | 0.0 |
| Wt. % C6 Olefins | 0.0 | 0.0 | 0.0 | 0.0 | 0.0 | 0.0 |
| Sulfur, ppm | 10 | 10 | 10 | 10 | 10 | 10 |
| Blended Cat Naphtha Products | 4-A | 4-B | 4-C | 4-D | 4-E | 4-F |
| Wt. % Total Olefins | 9.9 | 9.8 | 12.4 | 9.8 | 8.5 | 8.5 |
| Wt. % C5 Olefins | 5.4 | 5.8 | 7.2 | 4.7 | 5.1 | 5.3 |
| Wt. % C6 Olefins | 1.8 | 1.5 | 2.2 | 2.0 | 1.4 | 1.5 |
| Sulfur, ppm | 24.3 | 24.5 | 24.1 | 24.7 | 23.7 | 24.5 |
| % of Olefins that are C5 Olefins | 54.1% | 59.1% | 58.2% | 48.1% | 59.5% | 62.3% |
| % of Olefins that are C5 + C6 Olefins | 71.8% | 74.5% | 75.8% | 68.2% | 75.9% | 79.8% |

Comparative Example 5

With efficient fractionation, the end point of the LCN can be increased to 165° F. The following simulation illustrates a process employing a higher cut point between the LCN and ICN and 90% sulfur removal with 100% retention of the olefins in the 65–165° F. streams of Example 1 (Y–AD). In accordance with the simulation, the ICN streams of Example 1 (AE–AJ) were mildly hydrotreated with a conventional catalyst to reduce the sulfur content to 30 ppm S with 90% olefin saturation and the HCN streams of Example 1 (S–X) were severely hydrotreated to 10 ppm S with 100% saturation of the olefins. A simulated blending of the streams provided samples 5-A to 5-F in Table 8 below.

TABLE 8

| 65–165° F. treated by caustic extraction | | | | | | |
|---|---|---|---|---|---|---|
| Percentage of full cat naphtha | 23.8 | 26.1 | 25.7 | 21.0 | 30.9 | 23.3 |
| Wt. % Total Olefins | 55.5 | 47.7 | 61.8 | 63.6 | 38.9 | 52.6 |
| Wt. % C5 Olefins | 26.0 | 23.7 | 29.6 | 30.0 | 19.0 | 26.0 |
| Wt. % C6 Olefins | 27.8 | 22.4 | 30.6 | 30.3 | 18.0 | 24.6 |
| Sulfur, ppm | 11 | 10 | 15 | 17 | 4 | 17 |
| ICN 165–365° F. treated by mild hydrotreating | | | | | | |
| Percentage of full cat naphtha | 59.3 | 59.4 | 57.9 | 61.6 | 54.0 | 58.2 |
| Sulfur, ppm | 30 | 30 | 30 | 30 | 30 | 30 |
| % HDS | 95.3% | 93.7% | 96.8% | 97.3% | 72.1% | 94.1% |
| % Olefin Saturation | 90.0% | 90.0% | 90.0% | 90.0% | 90.0% | 90.0% |
| Wt. % Total Olefins | 2.5 | 2.1 | 2.7 | 2.8 | 1.7 | 1.4 |
| Wt. % C5 Olefins | 0.0 | 0.0 | 0.0 | 0.0 | 0.0 | 0.0 |
| Wt. % C6 Olefins | 0.3 | 0.2 | 0.3 | 0.4 | 0.2 | 0.2 |

TABLE 8-continued

| HCN 365–430° F. treated by severe hydrotreating | | | | | | |
|---|---|---|---|---|---|---|
| Percentage of full cat naphtha | 16.9 | 14.6 | 16.4 | 17.4 | 15.2 | 18.5 |
| Wt. % Total Olefins | 0.0 | 0.0 | 0.0 | 0.0 | 0.0 | 0.0 |
| Wt. % C5 Olefins | 0.0 | 0.0 | 0.0 | 0.0 | 0.0 | 0.0 |
| Wt. % C6 Olefins | 0.0 | 0.0 | 0.0 | 0.0 | 0.0 | 0.0 |
| Sulfur, ppm | 10 | 10 | 10 | 10 | 10 | 10 |
| Blended Cat Naphtha Products | 5-A | 5-B | 5-C | 5-D | 5-E | 5-F |
| Wt. % Total Olefins | 14.7 | 13.7 | 17.4 | 15.1 | 12.9 | 13.1 |
| Wt. % C5 Olefins | 6.2 | 6.2 | 7.6 | 6.3 | 5.9 | 6.1 |
| Wt. % C6 Olefins | 6.8 | 6.0 | 8.0 | 6.6 | 5.7 | 5.9 |
| Sulfur, ppm | 22.0 | 22.0 | 22.8 | 23.9 | 19.1 | 23.3 |
| % of Olefins that are C5 Olefins | 42.2% | 45.3% | 43.7% | 41.9% | 45.3% | 46.3% |
| % of Olefins that are C5 + C6 Olefins | 88.5% | 88.8% | 89.8% | 85.8% | 89.1% | 91.0% |

Example 6

By using a selective catalyst and HDS conditions that remove sulfur while minimizing olefin saturation, the percentage of $C_5$ and $C_5$+$C_6$ olefins can be altered significantly. In a simulation of such a process, 90% of the sulfur was removed while retain 100% of the olefins in the 65–115° F. streams of Example 1 (G–L). The ICN streams of Example 1 (M–R) were selectively hydrotreated with a selective catalyst to reduce the sulfur content to 30 ppm S with 12–40% olefin saturation (based on selective hydroprocessing model predictions) and the HCN streams of Example 1 (S–X) were severely hydrotreated to 10 ppm S with 100% saturation of the olefins. A simulated blending of these streams provided samples 6-A to 6-F in Table 9 below.

Example 7

The effect of raising the LCN endpoint from 115 to 165° F. in Example 6 was calculated in order to study the effect of 90% sulfur removal while retaining 100% of the olefins in the 65–165° F. streams of Example 1 (Y–AA). In accordance with the simulation, the ICN streams of Example 1 (AE–AJ) were selectively hydrotreated with a selective catalyst to reduce the sulfur content to 30 ppm S with 15–43% olefin saturation (based on selective hydroprocessing model predictions) and the HCN streams of Example 1 (S–X) were severely hydrotreated to 10 ppm S with 100% saturation of the olefins. A simulated blending of these streams provided samples 7-A to 7-F in Table 10 below.

TABLE 9

| 65–115° F. treated by caustic extraction | | | | | | |
|---|---|---|---|---|---|---|
| Percentage of full cat naphtha | 8.8 | 11.4 | 11.6 | 6.9 | 12.9 | 9.4 |
| Wt. % Total Olefins | 61.9 | 52.7 | 65.8 | 67.2 | 41.3 | 58.5 |
| Wt. % C5 Olefins | 58.9 | 49.8 | 61.1 | 62.8 | 37.7 | 54.7 |
| Wt. % C6 Olefins | 1.4 | 0.9 | 2.9 | 3.4 | 0.6 | 1.1 |
| Sulfur, ppm | 3 | 7 | 7 | 4 | 5 | 11 |
| ICN 115–365° F. treated by selective hydrotreating | | | | | | |
| Percentage of full cat naphtha | 74.3 | 74.0 | 72.0 | 75.7 | 71.9 | 72.1 |
| Sulfur, ppm | 30 | 30 | 30 | 30 | 30 | 30 |
| % HDS | 94.4% | 92.6% | 96.2% | 96.9% | 67.0% | 93.3% |
| % Olefin Saturation | 28.0% | 25% | 35% | 40% | 12% | 26% |
| Wt. % Total Olefins | 21.8 | 19.2 | 21.3 | 20.6 | 19.5 | 15.6 |
| Wt. % C5 Olefins | 1.0 | 0.5 | 0.5 | 1.6 | 1.2 | 1.0 |
| Wt. % C6 Olefins | 7.9 | 7.2 | 8.3 | 6.9 | 8.1 | 7.1 |
| HCN 365–430° F. treated by severe hydrotreating | | | | | | |
| Percentage of full cat naphtha | 16.9 | 14.6 | 16.4 | 17.4 | 15.2 | 18.5 |
| Wt. % Total Olefins | 0.0 | 0.0 | 0.0 | 0.0 | 0.0 | 0.0 |
| Wt. % C5 Olefins | 0.0 | 0.0 | 0.0 | 0.0 | 0.0 | 0.0 |
| Wt. % C6 Olefins | 0.0 | 0.0 | 0.0 | 0.0 | 0.0 | 0.0 |
| Sulfur, ppm | 10 | 10 | 10 | 10 | 10 | 10 |
| Blended Cat Naphtha Products | 6-A | 6-B | 6-C | 6-D | 6-E | 6-F |
| Wt. % Total Olefins | 21.7 | 20.2 | 23.0 | 20.2 | 19.4 | 16.7 |
| Wt. % C5 Olefins | 5.9 | 6.1 | 7.4 | 5.5 | 5.8 | 5.8 |
| Wt. % C6 Olefins | 6.0 | 5.4 | 6.3 | 5.5 | 5.9 | 5.2 |
| Sulfur, ppm | 24.3 | 24.5 | 24.1 | 24.7 | 23.7 | 24.5 |
| % of Olefins that are C5 Olefins | 27.3% | 30.0% | 32.3% | 27.4% | 29.6% | 34.8% |
| % of Olefins that are C5 + C6 Olefins | 55.1% | 56.7% | 59.7% | 54.4% | 60.0% | 66.0% |

TABLE 10

| 65–165° F. treated by caustic extraction | | | | | | |
|---|---|---|---|---|---|---|
| Percentage of full cat naphtha | 23.8 | 26.1 | 25.7 | 21.0 | 30.9 | 23.3 |
| Wt. % Total Olefins | 55.5 | 47.7 | 61.8 | 63.6 | 38.9 | 52.6 |
| Wt. % C5 Olefins | 26.0 | 23.7 | 29.6 | 30.0 | 19.0 | 26.0 |
| Wt. % C6 Olefins | 27.8 | 22.4 | 30.6 | 30.3 | 18.0 | 24.6 |
| Sulfur, ppm | 11 | 10 | 15 | 17 | 4 | 17 |
| ICN 165–365° F. treated by selective hydrotreating | | | | | | |
| Percentage of full cat naphtha | 59.3 | 59.4 | 57.9 | 61.6 | 54.0 | 58.2 |
| Sulfur, ppm | 30 | 30 | 30 | 30 | 30 | 30 |
| % HDS | 95.3% | 93.7% | 96.8% | 97.3% | 72.1% | 94.1% |
| % Olefin Saturation | 32.0% | 27% | 40% | 43% | 15% | 28% |
| Wt. % Total Olefins | 16.9 | 15.4 | 15.9 | 16.0 | 14.7 | 10.4 |
| Wt. % C5 Olefins | 0.0 | 0.0 | 0.0 | 0.1 | 0.0 | 0.0 |
| Wt. % C6 Olefins | 1.9 | 1.6 | 1.7 | 2.4 | 1.8 | 1.6 |
| HCN 365–430° F. treated by severe hydrotreating | | | | | | |
| Percentage of full cat naphtha | 16.9 | 14.6 | 16.4 | 17.4 | 15.2 | 18.5 |
| Wt. % Total Olefins | 0.0 | 0.0 | 0.0 | 0.0 | 0.0 | 0.0 |
| Wt. % C5 Olefins | 0.0 | 0.0 | 0.0 | 0.0 | 0.0 | 0.0 |
| Wt. % C6 Olefins | 0.0 | 0.0 | 0.0 | 0.0 | 0.0 | 0.0 |
| Sulfur, ppm | 10 | 10 | 10 | 10 | 10 | 10 |
| Blended Cat Naphtha Products | 7-A | 7-B | 7-C | 7-D | 7-E | 7-F |
| Wt. % Total Olefins | 23.2 | 21.5 | 25.1 | 23.2 | 19.9 | 18.3 |
| Wt. % C5 Olefins | 6.2 | 6.2 | 7.6 | 6.3 | 5.9 | 6.1 |
| Wt. % C6 Olefins | 7.8 | 6.8 | 8.8 | 7.8 | 6.5 | 6.7 |
| Sulfur, ppm | 22.0 | 22.0 | 22.8 | 23.9 | 19.1 | 23.3 |
| % of Olefins that are C5 Olefins | 26.7% | 28.7% | 30.3% | 27.3% | 29.5% | 33.1% |
| % of Olefins that are C5 + C6 Olefins | 60.1% | 60.3% | 65.6% | 61.1% | 62.2% | 69.4% |

Example 8

With selective HDS of the ICN stream, the total sulfur content can be reduced further still while retaining a high percentage of $C_5$+$C_6$ olefins. To illustrate this effect, a simulation was employed in which 90% of the sulfur was removed while retaining 100% of the olefins in the 65–115° F. streams of Example 1 (G–L). In accordance with the simulation, the ICN streams of Example 1 (M–R) were selectively hydrotreated with a selective catalyst to reduce the sulfur content to 10 ppm S with 25–55% olefin saturation (based on selective hydroprocessing model predictions) and the HCN streams of Example 1 (S–X) were severely hydrotreated to 10 ppm S with 100% saturation of the olefins. A simulated blending of these streams provided samples 8-A to 8-F in Table 11 below.

TABLE 11

| 65–115° F. treated by caustic extraction | | | | | | |
|---|---|---|---|---|---|---|
| Percentage of full cat naphtha | 8.8 | 11.4 | 11.6 | 6.9 | 12.9 | 9.4 |
| Wt. % Total Olefins | 61.9 | 52.7 | 65.8 | 67.2 | 41.3 | 58.5 |
| Wt. % C5 Olefins | 58.9 | 49.8 | 61.1 | 62.8 | 37.7 | 54.7 |
| Wt. % C6 Olefins | 1.4 | 0.9 | 2.9 | 3.4 | 0.6 | 1.1 |
| Sulfur, ppm | 3 | 7 | 7 | 4 | 5 | 11 |
| ICN 115–365° F. treated by selective hydrotreating | | | | | | |
| Percentage of full cat naphtha | 74.3 | 74.0 | 72.0 | 75.7 | 71.9 | 72.1 |
| Sulfur, ppm | 10 | 10 | 10 | 10 | 10 | 10 |
| % HDS | 98.1% | 97.5% | 98.7% | 99.0% | 89.0% | 97.8% |
| % Olefin Saturation | 50.0% | 45% | 55% | 60% | 25% | 47% |
| Wt. % Total Olefins | 15.2 | 14.1 | 14.8 | 13.8 | 16.7 | 11.2 |
| Wt. % C5 Olefins | 0.7 | 0.4 | 0.3 | 1.1 | 1.0 | 0.7 |
| Wt. % C6 Olefins | 5.5 | 5.2 | 5.7 | 4.6 | 6.9 | 5.1 |
| HCN 365–430° F. treated by severe hydrotreating | | | | | | |
| Percentage of full cat naphtha | 16.9 | 14.6 | 16.4 | 17.4 | 15.2 | 18.5 |
| Wt. % Total Olefins | 0.0 | 0.0 | 0.0 | 0.0 | 0.0 | 0.0 |
| Wt. % C5 Olefins | 0.0 | 0.0 | 0.0 | 0.0 | 0.0 | 0.0 |
| Wt. % C6 Olefins | 0.0 | 0.0 | 0.0 | 0.0 | 0.0 | 0.0 |
| Sulfur, ppm | 10 | 10 | 10 | 10 | 10 | 10 |
| Blended Cat Naphtha Products | 8-A | 8-B | 8-C | 8-D | 8-E | 8-F |
| Wt. % Total Olefins | 16.7 | 16.4 | 18.3 | 15.0 | 17.3 | 13.5 |
| Wt. % C5 Olefins | 5.7 | 6.0 | 7.3 | 5.1 | 5.6 | 5.6 |
| Wt. % C6 Olefins | 4.2 | 4.0 | 4.5 | 3.7 | 5.0 | 3.8 |

TABLE 11-continued

| | | | | | | |
|---|---|---|---|---|---|---|
| Sulfur, ppm | 9.4 | 9.7 | 9.7 | 9.6 | 9.4 | 10.1 |
| % of Olefins that are C5 Olefins | 34.1% | 36.3% | 40.1% | 34.1% | 32.5% | 41.5% |
| % of Olefins that are C5 + C6 Olefins | 59.3% | 60.6% | 64.5% | 59.0% | 61.5% | 69.4% |

Example 9

The selective hydrotreating of ICN can be improved further still by using two-stage selective hydroprocessing, which further improves olefin retention. In a simulation illustrating such a process, 90% of the sulfur was removed while retaining 100% of the olefins in the 65–115° F. streams of Example 1 (G–L). In accordance with the simulation, the ICN streams of Example 1 (M–R) were selectively hydrotreated in a two-stage process with a selective catalyst to reduce the sulfur content to 30 ppm S with 6–25% olefin saturation (based on selective hydroprocessing model predictions) and the HCN streams of Example 1 (S–X) were severely hydrotreated to 10 ppm S with 100% saturation of the olefins. A simulated blending of these streams provided samples 9-A to 9-F in Table 12 below.

TABLE 12

| | | | | | | |
|---|---|---|---|---|---|---|
| 65–115 ° F. treated by caustic extraction | | | | | | |
| Percentage of full cat naphtha | 8.8 | 11.4 | 11.6 | 6.9 | 12.9 | 9.4 |
| Wt. % Total Olefins | 61.9 | 52.7 | 65.8 | 67.2 | 41.3 | 58.5 |
| Wt. % C5 Olefins | 58.9 | 49.8 | 61.1 | 62.8 | 37.7 | 54.7 |
| Wt. % C6 Olefins | 1.4 | 0.9 | 2.9 | 3.4 | 0.6 | 1.1 |
| Sulfur, ppm | 3 | 7 | 7 | 4 | 5 | 11 |
| ICN 115–365 ° F. two stage selective hydrotreating | | | | | | |
| Percentage of full cat naphtha | 74.3 | 74.0 | 72.0 | 75.7 | 71.9 | 72.1 |
| Sulfur, ppm | 30 | 30 | 30 | 30 | 30 | 30 |
| % HDS | 94.4% | 92.6% | 96.2% | 96.9% | 67.0% | 93.3% |
| % Olefin Saturation | 20% | 15% | 22% | 25% | 6% | 18% |
| Wt. % Total Olefins | 24.2 | 21.7 | 25.6 | 25.8 | 20.9 | 17.3 |
| Wt. % C5 Olefins | 1.1 | 0.6 | 0.6 | 2.0 | 1.3 | 1.1 |
| Wt. % C6 Olefins | 8.8 | 8.1 | 9.9 | 8.7 | 8.6 | 7.9 |
| HCN 365–430 ° F. treated by severe hydrotreating | | | | | | |
| Percentage of full cat naphtha | 16.9 | 14.6 | 16.4 | 17.4 | 15.2 | 18.5 |
| Wt. % Total Olefins | 0.0 | 0.0 | 0.0 | 0.0 | 0.0 | 0.0 |
| Wt. % C5 Olefins | 0.0 | 0.0 | 0.0 | 0.0 | 0.0 | 0.0 |
| Wt. % C6 Oletins | 0.0 | 0.0 | 0.0 | 0.0 | 0.0 | 0.0 |
| Sulfur, ppm | 10 | 10 | 10 | 10 | 10 | 10 |
| Blended Cat Naphtha Products | 9-A | 9-B | 9-C | 9-D | 9-E | 9-F |
| Wt. % Total Olefins | 23.5 | 22.1 | 26.0 | 24.1 | 20.4 | 18.0 |
| Wt. % C5 Olefins | 6.0 | 6.1 | 7.5 | 5.8 | 5.8 | 5.9 |
| Wt. % C6 Olefins | 6.7 | 6.1 | 7.5 | 6.8 | 6.3 | 5.8 |
| Sulfur, ppm | 24.3 | 24.5 | 24.1 | 24.7 | 23.7 | 24.5 |
| % of Olefins that are C5 Olefins | 25.6% | 27.7% | 28.8% | 24.2% | 28.5% | 32.9% |
| % of Olefins that are C5 + C6 Olefins | 54.0% | 55.3% | 57.5% | 52.3% | 59.4% | 65.0% |

What is claimed is:

1. A hydrocarbon boiling in the naphtha boiling range comprising $C_5$, olefins, $C_6$ olefins, and olefins having more than 6 carbon atom, wherein (i) the hydrocarbon contains more than about 12 wt. % olefins, based on the weight of the hydrocarbon;

(ii) the hydrocarbon contains an amount of olefins having five or more carbon atoms that are the $C_5$ and the $C_6$ olefins ranging from about 37% to about 84%; and (iii) the hydrocarbon contains less than about 60 ppm sulfur, based on the weight of the hydrocarbon.

2. The hydrocarbon of claim 1 wherein the hydrocarbon contains a lower boiling light portion and a higher boiling heavy portion, wherein the light fraction is present in an amount about 15 wt. % to about 30 wt. % of the hydrocarbon, the balance of the hydrocarbon being substantially the heavy fraction.

3. The hydrocarbon of claim 2 further comprising 50 to 70 wt. % of a second hydrocarbon containing at least one of light virgin naphtha, reformate, isomerate, alkylate, and butanes, and wherein the hydrocarbon contains about 2 wt. % to about 12 wt. % olefins, and wherein at least about 25% of the hydrocarbon's olefins $C_5$ olefins.

* * * * *